United States Patent [19]

Motegi et al.

[11] Patent Number: 4,971,310

[45] Date of Patent: Nov. 20, 1990

[54] PAPER SHEET TAKEOUT APPARATUS

[75] Inventors: Isamu Motegi, Kanagawa; Hisayuki Hiroki, Tokyo; Toshitaka Sakoguchi; Yoshiaki Maruyama, both of Kanagawa, all of Japan

[73] Assignee: Kabushiki Kaisha Toshiba, Kawasaki, Japan

[21] Appl. No.: 354,812

[22] Filed: May 22, 1989

[30] Foreign Application Priority Data

Jun. 23, 1988 [JP] Japan ..... 63-153482

[51] Int. Cl.[5] ..... B65H 1/08

[52] U.S. Cl. ..... 271/126; 271/157; 271/160; 271/165

[58] Field of Search ..... 271/10, 119, 120, 121, 271/122, 124, 125, 126, 157, 160, 165, 147

[56] References Cited

U.S. PATENT DOCUMENTS

| | | | |
|---|---|---|---|
| 1,061,585 | 5/1913 | Armstrong | 271/119 |
| 2,394,410 | 2/1946 | Tascher | 271/119 |
| 4,483,124 | 11/1984 | Ohba et al. | 53/54 |
| 4,733,765 | 3/1988 | Watanabe | 271/160 X |

FOREIGN PATENT DOCUMENTS

| | | | |
|---|---|---|---|
| 0109743 | 9/1983 | European Pat. Off. . | |
| 6087136 | 5/1985 | Japan | 271/165 |
| 60-102341 | 6/1985 | Japan . | |
| 2037261 | 7/1980 | United Kingdom | 271/160 |

*Primary Examiner*—David H. Bollinger

*Attorney, Agent, or Firm*—Cushman, Darby & Cushman

[57] ABSTRACT

A paper sheet takeout apparatus has an eccentric roller rotatably supported and placed against one side of a stack of paper sheets. The roller feeds the paper sheets one-by-one. The stacked paper sheets are urged toward the eccentric roller by a backup member. The back up member is urged toward the stacked paper sheets by a base member. There is provided an absorbing member between the backup member and the base member. During the takeout operation, the backup member vibrates due to the eccentric rotation of the eccentric roller. With the absorbing member, such as a coil spring between the backup member and the base member, vibrations are absorbed so as to continuously take sheets out one-by-one.

9 Claims, 6 Drawing Sheets

PAPER SHEET TAKEOUT APPARATUS

BACKGROUND OF THE INVENTION

1. Field of the Invention

The present invention relates to a paper sheet takeout apparatus for taking out stacked paper sheets, such as banknotes, checks, slips, etc., one-by-one.

2. Description of Related Art

Many types of sheet takeout apparatus for taking out and feeding paper sheets, such as banknotes and checks one-by-one, are now widely used in sheet sorting apparatus. In the sheet takeout apparatus, the paper sheets placed into a supplying chamber are pushed in a predetermined direction by a back-up member so that the foremost one of the paper sheets abut against a pair of feed rollers. The foremost one of the paper sheets is taken out one-by-one by frictional engagement of the feed rollers.

For example, Japanese Patent Disclosure (Kokai) No. 60-102341 teaches a device including a pair of takeout rollers and a pair of eccentric feed rollers. The eccentric feed rollers are mounted on a rotatable shaft so that a part of the surface of each roller projects into a supplying chamber according to the rotation of the rotatable shaft. The eccentric feed rollers allow for gaps to naturally occur between the sheets taken out without the need to stop the rollers. However, with this structure, the eccentric feed rollers vibrate the backup member. This decreases the urging force of the backup member and the feed rollers cannot continuously take out the sheets.

SUMMARY OF THE INVENTION

Accordingly, it is an object of the present invention to provide an apparatus for continuously taking out sheets from a stack.

This and other objects of the invention are achieved by providing an improved paper sheet takeout apparatus including an eccentric roller rotatably supported and placed against one side of the stacked paper sheets for feeding the paper sheets one-by-one, a backup member for urging the stacked paper sheets against the eccentric roller, a base member for urging the backup member toward the stacked paper sheets, and an absorbing member, arranged between the backup member and the base member for absorbing vibrations of the backup member.

DETAILED DESCRIPTION OF THE PREFERRED EMBODIMENT

Figure 1:
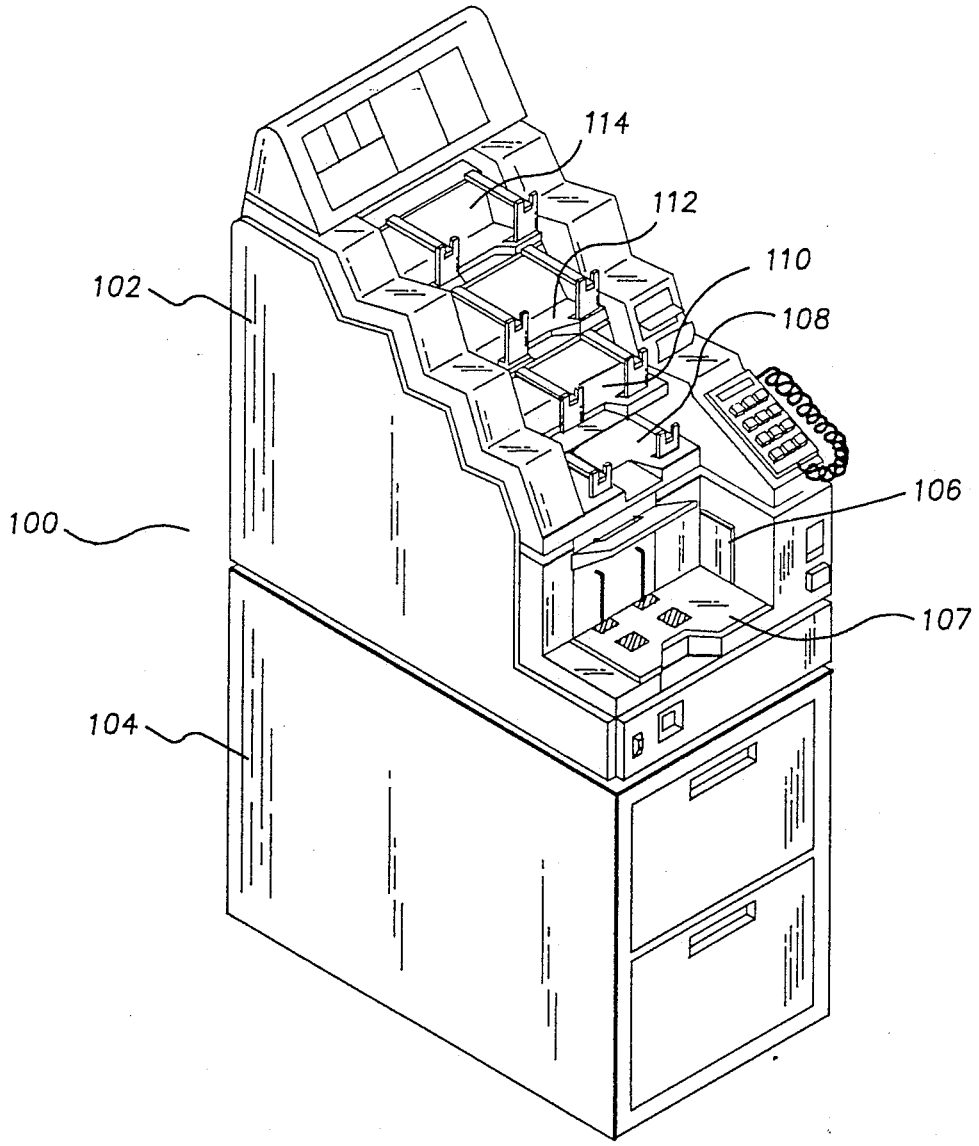
FIG. 1 is a schematic perspective view of a note-sorting/bundling apparatus for a sheet processing apparatus according to the present invention.

An embodiment of the present invention will be described with reference to the accompanying drawings. FIG. 1 shows an outer view of apparatus to which an embodiment of the sheet takeout apparatus according to the present invention may be applied.

A note-sorting/bundling apparatus 100 has upper and lower housing 102 and 104. Upper housing 102 contains a note-sorting device. Lower housing 104 contains a note-bundling device. The upper surface of upper housing 102 is stepped. A banknote supplying portion 106, on which a mixture of banknotes of different denominations is placed, is provided on the upper surface of a lowermost step 107. First to fourth note-stackers 108, 110, 112 and 114 are provided on the remaining steps on the upper surface of upper housing 102 so as to stack a plurality of banknotes, sorted by the note-sorting device.

Figure 2:
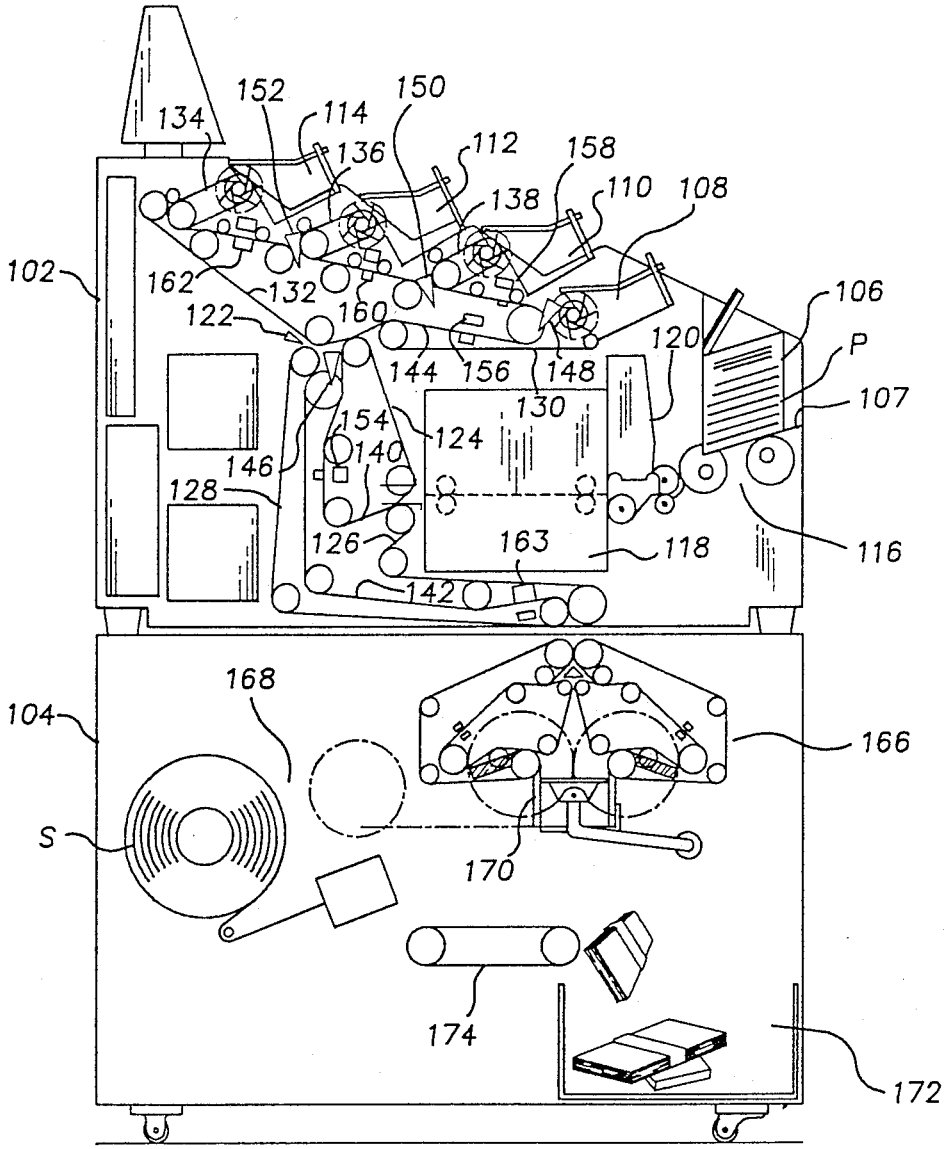
FIG. 2 is a schematic side view showing the interior of the upper and lower housings of the note-sorting-/bundling apparatus shown in FIG. 1.

FIG. 2 schematically shows the interior of upper and lower housings 102 and 104. The mixture of different denomination notes lies on note-supplying portion 106. A takeout device 116, is arranged under supplYing portion 106. Takeout device 116 takes banknotes one by one from supplying portion 106, and supplies each note to a note-discriminating device 118 through a thickness detector 120. Detector 120 detects whether two or more banknotes are taken in simultaneously by takeout device 116, and whether foreign matter, such as adhesive tape, is adhered to a single note. Takeout device 116 and detector 120 create a path for conveying banknotes one-by-one from note-supplying portion 106 to discriminating device 118.

Discriminating device 118 discriminates the denomination (e.g., four denominations), authenticity, condition (the extent of damage) and orientation of the conveyed banknote.

A conVeying device 122 has a combination of endless conveying belts 124, 126, 128, 130, 132, 134, 136 and 138 and rotating rollers, around which these belts are wound. Conveying device 122 is arranged at the outlet of discriminating device 118. Conveying device 122 has a main conveying path 140, a second conveying path 142 and a sorting conveying path 1 44. First to fourth note stackers 108, 110, 112, and 114 are located at ends of sorting conveying path 144. In this arrangement, first to fourth note stackers 108, 110, 112 and 114 stack reject notes, a first kind of notes, a second kind of notes, and a third kind of notes, respectively.

A first selector gate 146 is disposed at the terminal end of main conveying path 140 to selectively guide a note which reaches gate 146 to one of second conveying path 142 and sorting conveying path 144. Selector gates 148, 150 and 152 are disposed at the branch portions of sorting conveying path 144 to selectively guide a banknote to one of first to fourth note stackers 108, 110, 112 and 114.

Optical detecting deVices 154, 156, 158, 160 and 162 are also arranged on each of the conveying paths immediately before selector gates 146, 148, 150 and 152, respectively, that is immediately before a branch point located at the end of each of the conveying paths.

Selector gates 146, 148, 150 and 152 guide the banknotes supplied from main conveying path 140 to a corresponding conveying path and an associated stacker in accordance with the discrimination results of discriminating device 118. Selector gates 146, 148, 150 and 152 are controlled by a control unit (not shown) connected to discriminating device 118 and optical detecting devices 154, 156, 158, 160 and 162. An optical detecting device 163 is arranged at a point immediately before the end of second conveying path 142.

Lower housing 104 has a collecting device 166 and a bundling device 168. Collecting device 166 causes the banknotes supplied from second conveying path 142 one-by-one to be positioned in the same orientation and collects the banknotes in a collecting chamber 170. Hence, the obverse/reverse side of the banknotes stacked in collecting chamber 170 are aligned on the same side. When the number of banknotes stacked in collecting chamber 170 reaches a predetermined number (e.g., 100), the predetermined number of notes in collecting chamber 170 are supplied to bundling device 168. The predetermined number of banknotes are bundled by a strip S and bundling device 168. The bundled banknotes are conveyed from the bundling position to a note bundle stacker 172 by a conveying device 174 and are stacked thereat.

The detailed structure and operation of the note bundling device is disclosed in U.S. Pat. No. 4,483,124.

Figure 3:
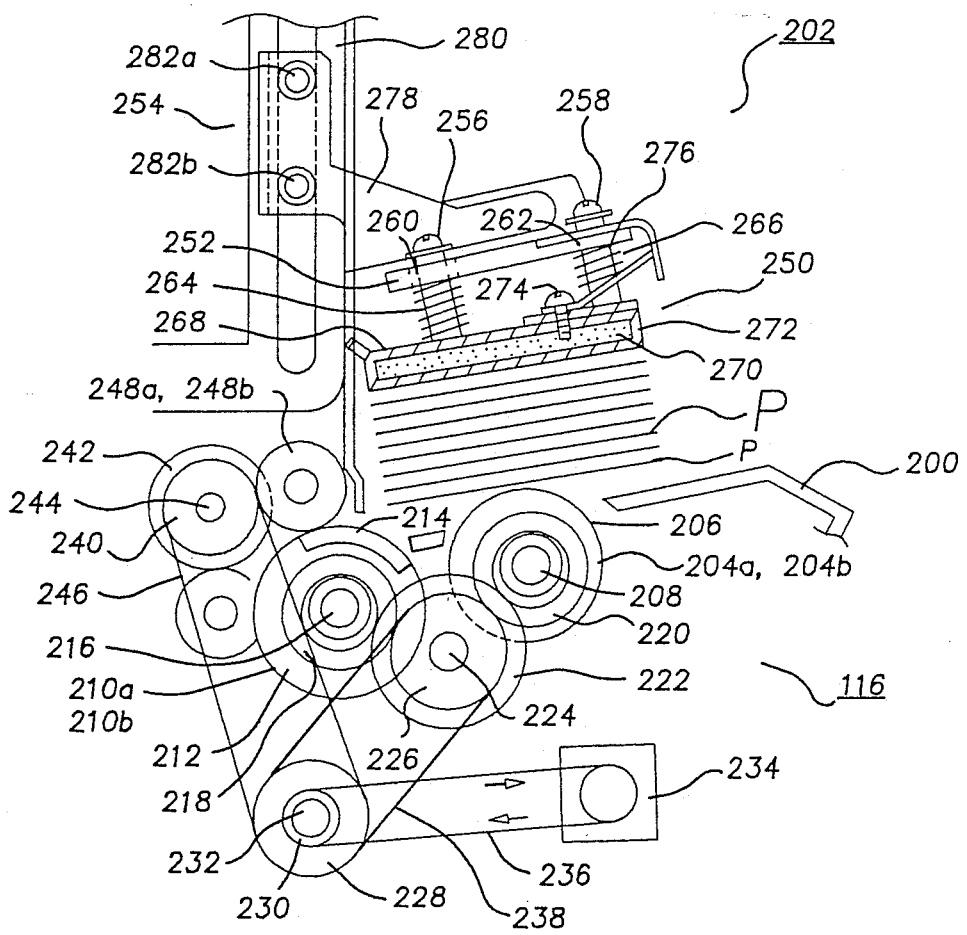
FIG. 3 is a schematic side view showing a takeout device of the note-sorting/bundling apparatus shown in FIG. 1.

In FIG. 3, a base member 200 forms the lowermost step 107. A number of banknotes P (e.g., about 1,000 sheets) can be stored in the supplying portion 106, arranged in a vertical posture on the lowermost step 107.

The banknotes P stored in the supplying portion 106 are biased downwardly by a backup mechanism 202 so that the foremost one of the paper sheets P abuts against feed rollers 204*a* and 204*b*. Feed rollers 204*a* and 204*b* are held in an opening 206 (as shown in FIG. 3) formed in a base member 200 so that parts of their peripheral surfaces project into the supplying portion 106.

Feed rollers 204*a* and 204*b* are eccentrically supported on the shaft 208. Thus, the outer peripheral surfaces of feed rollers 204*a* and 204*b* partially project above base member 200 through opening 206 associated with the rotation of the feed roller drive shaft 208.

Takeout rollers 210*a* and 210*b* are each formed of a core member 212 and a friction member 214 put on the whole outer peripheral surface of a core member 212 by backing.

As shown in FIG. 3, takeout rollers 210*a* and 210*b* as takeout means and the feed rollers 204*a* and 204*b* are mounted on a takeout roller drive shaft 216 and feed roller drive shaft 208, respectively, which are rotatably supported at both ends thereof by side bases (not shown).

A gear 218 and a gear 220 are attached to the end of the takeout roller drive shaft 216 and feed roller drive shaft 208, respectively. An intermediate gear 222, which is meshed with both of gears 218 and 220, is mounted on shaft 224, which is rotatably supported by side bases (not shown).

Arranged in this manner, takeout rollers 210*a* and 210*b* and feed rollers 204*a* and 204*b* rotate simultaneously in the same direction. A gear 226 is also mounted on shaft 224. A gear 228 and a gear 230 are attached to a shaft 232. A drive motor 234 drives gear 230 through a belt 236. A timing belt 238 is arranged between gear 228 and gear 226, so that motor 234 drives gear 226.

A gear 240 and a conveying roller 242 are mounted on a shaft 244. Gear 240 is connected to gear 228 by a timing belt 246, so that motor 234 drives conveying roller 242.

Gate rollers (gap rollers) 248*a* and 248*b* which act as gate members for preventing takeout of two or more banknotes P at a time face the outer takeout rollers 210*a* and 210*b*, respectively.

The positions of gate rollers 248*a* and 248*b* can be adjusted so that the gaps between gate rollers 248*a* and 248*b* and their corresponding takeout rollers 210*a* and 210*b*, respectively, are just as wide as the thickness of one banknote.

As shown in FIG. 3, backup mechanism 202 includes a backup member 250, a support base 252 supporting backup member 250, and an urging mechanism 254 urging the support base 252 toward base member 200.

Backup member 250 includes a movable member 268 which is attached to one end of shafts 256 and 258. The other ends of shafts 256 and 258 are slidably held by support base 252 so as to be able to reciprocate along the stacking direction of the banknotes through linear bearings 260 and 262. Coil springs 264 and 266 are arranged around the shafts 256 and 258, respectively. Coil springs 264 and 266 are positioned between movable member 268 and supporting base 252, so that movable member 268 is normally urged toward the feed rollers 204*a* and 204*b* by the restoring force of coil springs 264 and 266.

A resilient pad such as sponge rubber member 270 is attached under movable member 268, and static electricity conductive film 272 is arranged around the peripheral edges of sponge rubber member 270. The end of static electricity conductive film 272 is fixed on movable member 268 by a screw 274. An electricity conductive brush 276 is also fixed on movable member 268 by screw 274. An end of brush 276 contacts support base 252, so that electrostatic charges generated around banknotes P are discharged to supporting base 252 and then to ground.

Figure 4:
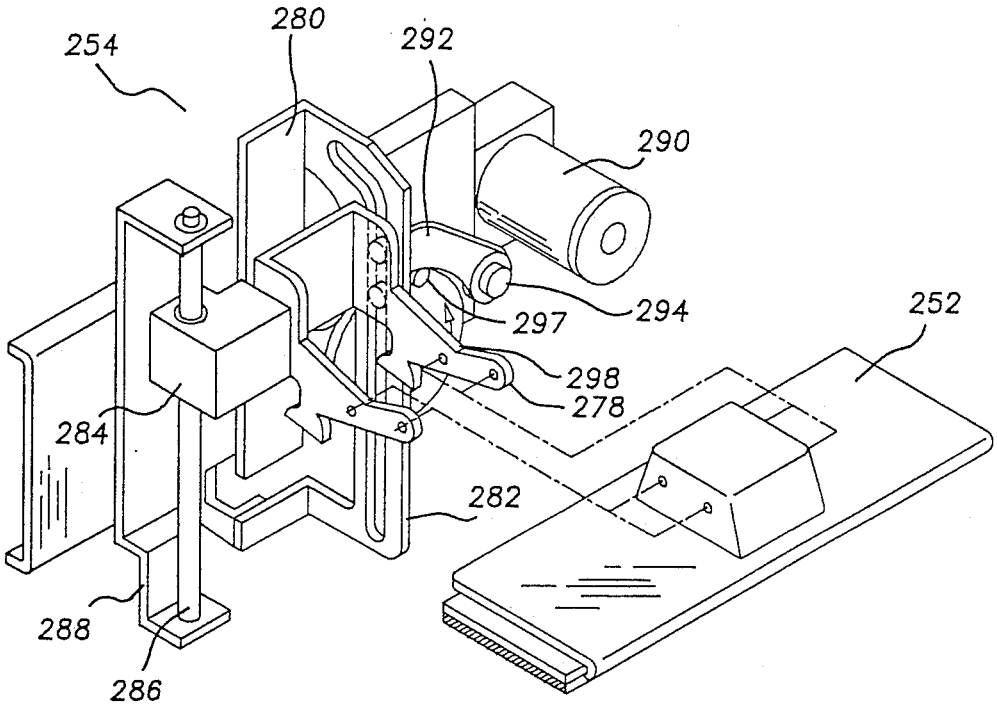
FIG. 4 is a perspective view showing an urging mechanism of the takeout device shown in FIG. 3.

Support mechanism 252 includes an arm 278 and a guide frame 280 supporting arm 278. Guide rollers 282*a* and 282*b* are attached on one side to the end of arm 278. As shown in FIG. 4, guide frame 280 is arranged on the rear side of arm 278. Guide rollers 282*a* and 282*b* are in rolling contact with guide frame 280, so that backup member 250 can reciprocate along the direction of the arrangement of the banknotes in supplying portion 106.

Urging mechanism 254 includes a weight 284 and a shaft 286 supporting weight 284. Weight 284 is attached to the other side of arm 278. Weight 284 is reciprocably supported by shaft 286 which is fixed on a weight frame 288. Weight 284 can be moved away from base member 200 in response to pulse motor 290.

Figure 5:
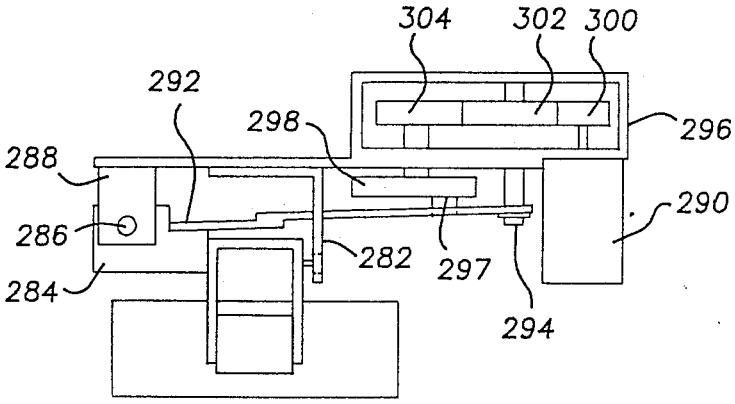
FIG. 5 is a plan view showing the urging mechanism shown in FIG. 4.

As shown in FIG. 5, a driving arm 292 is pivotally supported on a pivot shaft 294 which is mounted on a base 296. The end portion of driving arm 292 is adapted to push weight 284 away from base member 200. A drive roller 297 is rotatably attached to a rotating disk 298 which is driven by pulse motor 290 through gears 300, 302 and 304. Drive roller 297 is in rolling contact with driving arm 292 so that the driving force of the pulse motor 290 is transmitted to the weight 284. Thus, weight 284 and supporting base 252 is moved upward by pulse motor 290 so that banknotes can be inserted in supply portion 107. Then pulse motor 290 rotates so that driving arm 292 separates from weight 284 so that weight 284 applies the force of gravity against notes in supply portion 106.

Figure 6A:
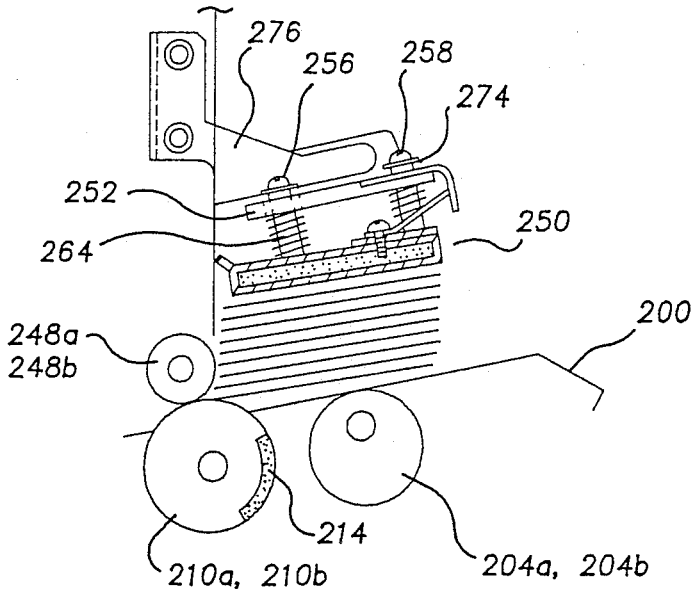
FIG. 6(*a*) to FIG. 6(*c*) are side views explaining the operation of the takeout device.
Figure 6B:
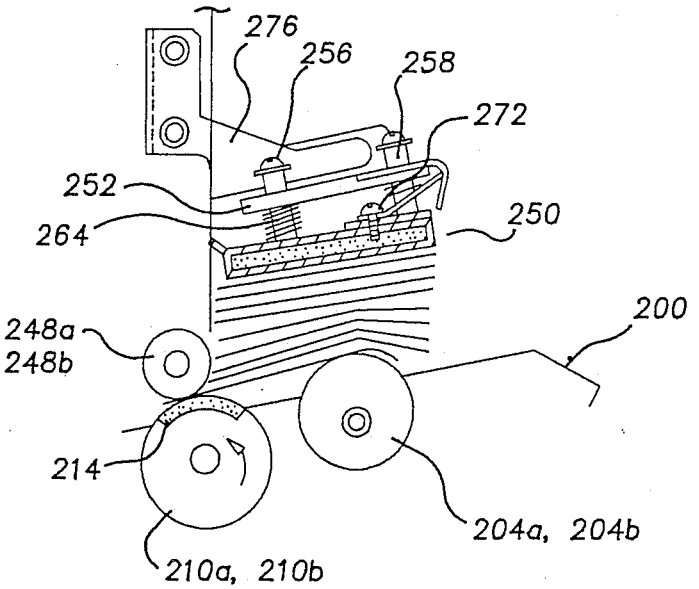
Figure 6C:
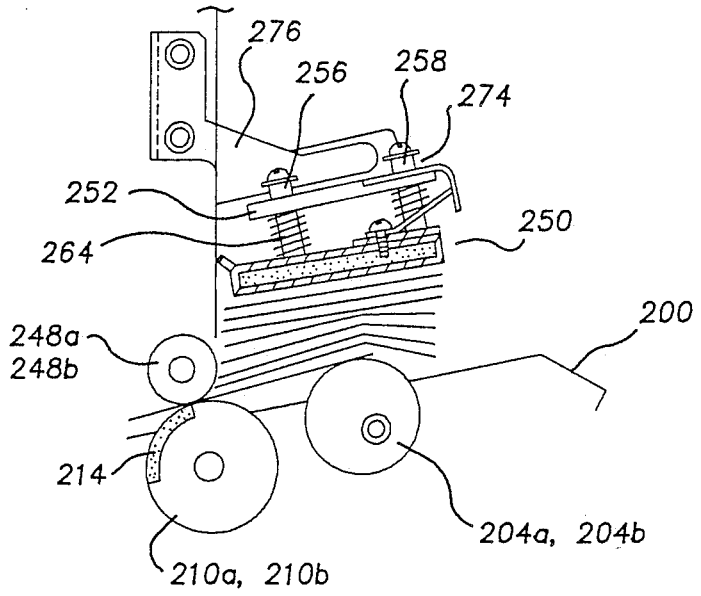

The process for taking out banknotes will be described with reference to FIGS. 6(*a*) to 6(*c*). Backup member 250 is normally located in a neutral position, uppermost in supplying portion 106 (see FIGURE I). When an operator supplies a mixture of banknotes into supplying portion 106, the operator designates the start of a takeout operation. Pulse motor 290 moves driving arm 292 to separate from weight 284 so that weight 284 moves downwards under its own weight. Thus, the underlying banknotes P are pressed, under a proper contact pressure for feed out (as shown in FIG. 6(*a*)). Thereafter, motor 234 drives feed rollers 204*a* and 204*b*, takeout rollers 210*a* and 210*b* and conveying rollers 242 (FIG. 3). The outer peripheral surfaces of feed rollers 204*a* and 204*b* partially project beyond supplying base 200 through opening 206. Thereupon, the lowermost banknote is fed by the frictional force of feed rollers 204*a* and 204*b* (FIG. 6(*b*)). At the same time, backup member 250 moves upwardly due to the eccentricity of feed rollers 204*a* and 204*b*. Backup member 250 returns to its previous position by the force of coil springs 264 and 266 according to the rotation of feed rollers 204*a* and 204*b* (as shown in FIGS. 6(*c*)). As mentioned above, the vibration of back member 250 is absorbed by the coil springs 264 and 266, so that the banknote P is pressed under a proper and continuous contact pressure for feed out against the feed rollers 204*a* and 204*b*.

The lowermost banknote P is fed out by the feed rollers 204*a* and 204*b* so that a front edge of banknotes P securely engages takeout rollers 210*a* and 210*b*. Then friction members 214 on portions of the outer peripheral surfaces of takeout rollers 210*a* and 210*b* face and touch the front edge of the lowermost banknote. Thus, the lowermost banknote P is taken out and conveyed to conveying roller 242 by the friction of friction member 214. The lowermost banknote P taken out in this manner is then conveyed out by conveying roller 242.

In the above embodiment, the backup member is supported by the base through the coil springs as urging means. However, the urging means are not limited to coil springs. For example, elastic rubber and leaf springs may be used as the urging means.

What is claimed is:

1. Paper sheet takeout apparatus for taking out stacked paper sheets one-by-one comprising:

an eccentric roller, rotatably supported and placed against one side of the stacked paper sheets, for feeding the paper sheets one-by-one;

a backup member for urging the stacked paper sheets against said eccentric roller;

a base member for guiding sadi backup member along the stacking direction;

an absorbing member, arranged between said backup member and said base member, for absorbing vibrations of said backup member;

an conductive film covering at least a portion of said backup member contacting the stacked paper sheets; and means for conducting charges from said film to ground.

2. Paper sheet takeout apparatus as claimed in claim 1, further including means for urging said base member toward the stacked paper sheets.

3. Paper sheet takeout apparatus as claimed in claim 2, wherein said urging means includes a weight, coupled to said base member and slidable parallel to gravity.

4. Paper sheet takeout apparatus as claimed in claim 3 further comprising means for lifting said weight against gravity to allow insertion of paper sheets in said takeout apparatus and for releasing said weight after insertion to allow said backup member to urge the stacked paper sheets.

5. Paper sheet takeout apparatus as claimed in claim 4, wherein said lifting means comprises:

a rotating cam; and a rotatable driving arm having one portion engaging said rotating cam and one portion engageable with said weigth for lifting said weight.

6. Paper sheet takeout apparatus as claimed in claim 1, wherein said conducting means comprises a brush electrically interconnecting said film and said base member.

7. Paper sheet takeout apparatus as claimed in claim 1, wherein said backup member includes a resilient pad for contacting the stacked paper sheets.

8. Paper sheet takeout apparatus as claimed in claim 1, wherein said absorbing member includes at least one coil spring disposed between said base member and said backup member.

9. Paper sheet takeout apparatus for taking out stacked paper sheets one-by-one comprising:

an eccentric roller, rotatably supported and placed against one side of the stacked paper sheets, for feeding the paper sheets one-by-one;

a backup member for urging the stacked paper sheets against said eccentric roller;

a base member for guiding said backup member along the stacking direction;

an absorbing member, arranged between said backup member and said base member, for absorbing vibration of said backup member;

a weight, coupled to said base member and slidable parallel to gravity;

a rotating cam;

a rotatable driving arm having one portion engaging said rotating cam and one portion engageable with said weight for lifting said weight against gravity to allow insertion of paper sheets in said takeout apparatus and for releasing said weight after insertion to allow said backup member to urge the stacked paper sheets; and means for discharging charges from the stacked paper sheets to ground.

* * * * *